US012004627B2

(12) United States Patent
Hwang et al.

(10) Patent No.: US 12,004,627 B2
(45) Date of Patent: Jun. 11, 2024

(54) SHOCK ABSORBING COSMETIC COMPACT

(71) Applicant: Crystal International (Group) Inc.

(72) Inventors: Roger Hwang, Maple (CA); Stephen M Fisher, II, Sherman, CT (US); William Lloyd Alusitz, Yorktown Heights, NY (US)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 457 days.

(21) Appl. No.: 16/825,433

(22) Filed: Mar. 20, 2020

(65) Prior Publication Data

US 2021/0289915 A1 Sep. 23, 2021

(51) Int. Cl.
*A45D 33/00* (2006.01)

(52) U.S. Cl.
CPC ..... *A45D 33/003* (2013.01); *A45D 2200/05* (2013.01)

(58) Field of Classification Search
CPC . A45D 33/003; A45D 33/008; A45D 2200/05
See application file for complete search history.

(56) References Cited

U.S. PATENT DOCUMENTS 5,135,012 A 8/1992 Kamen et al.
5,682,910 A 11/1997 Kizawa et al.
6,055,992 A 5/2000 Skarne
2003/0183240 A1* 10/2003 Manougian ..... A45D 33/006 132/295
2006/0231117 A1* 10/2006 Manougian ..... A45D 40/22 132/295
2015/0223583 A1* 8/2015 Greenfield ..... B65D 81/07 132/316

FOREIGN PATENT DOCUMENTS

FR 3086149 * 3/2020 ..... A45D 33/006
KR 20140003526 * 6/2014 ..... A45D 33/00
KR 20160135875 * 11/2016 ..... A54D 40/00
KR 20210058430 * 5/2021 ..... A45D 40/20

* cited by examiner

*Primary Examiner* — J C Jacyna
(74) *Attorney, Agent, or Firm* — Patterson + Sheridan, LLP

(57) ABSTRACT

A cosmetic compact for solid or semi solid cosmetic product. The cosmetic compact comprising a lid and a base assembly, wherein the base assembly comprising a base, a frame, a shock absorbing member, and at least one cosmetic pan. The shock absorbing member is disposed within a cavity of the base and is shaped substantially corresponding to a shape of the cavity of the base. The shock absorbing member is coupled to the base and is coupled to the at least one cosmetic pan such that shock imparted on the cosmetic compact is isolated from the at least one cosmetic pan. The shock absorbing member comprises at least a sheet of material having a honey comb structure i.e. the shock absorbing member comprises at least one sheet of a material having a plurality of honeycomb hexagonal voids.

18 Claims, 3 Drawing Sheets

SHOCK ABSORBING COSMETIC COMPACT

BACKGROUND

Field of the Invention

The present disclosure relates to a cosmetic compact that includes a shock absorbing member to protect against damage from shocks.

Description of the Related Art

Hinged cosmetic containers such as cosmetic compacts are commonly used to hold various cosmetics or make-up including face powder, blush, eye shadow, lip color, and the like. Indeed, virtually every type of make-up can be provided in a form suitable for being contained in a cosmetic compact. Cosmetic compacts allow one or more cosmetics in quantities sufficient for multiple applications to be conveniently stored and/or transported, particularly in receptacles such as cosmetic carriers, handbags or purses, for access and use on demand. Accordingly, cosmetic compacts are very prevalent and highly popular.

Conventional cosmetic compacts typically include a housing, a lid pivotally mounted to a base for movement between closed and open positions, and one or more cosmetics contained in the interior of the base. The housings of conventional cosmetic compacts are ordinarily made of substantially rigid or brittle materials, such as plastics and/or metals. Since it is not unusual for cosmetic compacts to be subjected to shocks, such as impacts, vibrations or jarring forces, during use, storage and/or transport, the contents thereof often sustain irreparable damage. The cosmetics within the housings may crack, fracture, chip or crumble. Cosmetics may leak out of damaged housings, and damaged cosmetics may leak out of even intact housings. Damaged cosmetic compacts, therefore, are usually disposed of by their users prematurely, thus resulting in economic loss.

A cosmetic compact having a flexible housing made of a plastic or rubber elastomeric foam to protect against damage from shocks has been proposed in U.S. Pat. No. 6,055,992 to Skarne. A significant drawback to the proposed cosmetic compact is that the flexible housing must rely for dimensional stability upon a dimensionally sturdy mirror and a dimensionally sturdy cosmetic compartment or tray disposed in the lid and base, respectively, of the housing. The dimensional instability of the housing when the mirror and/or the cosmetic compartment are not installed therein renders the compact unsuitable for use when some of the contents are removed.

U.S. Pat. No. 5,135,012 to Kamen et al discloses a cosmetic compact in which the lid and base of the housing are flexible due to being made of a piece of thermoplastic material of nominal thickness. The nominal thickness of the lid and base reduces the structural strength of the housing and provides little protection for the contents against damage from shocks.

U.S. Pat. No. 5,682,910 to Kizawa et al discloses a compact having a soft area along a front wall thereof to define a push button for releasing hooks used to maintain the compact in a closed position. The location and design of the soft area make it ineffective for shock absorption.

From the foregoing, it can be seen that a need exists for cosmetic containers which are better protected to absorb shocks.

SUMMARY

Accordingly, it is a primary object of the present disclosure to provide a cosmetic compact having a shock absorbing member.

Accordingly, the present disclosure is directed to means for dampening shocks, impacts and vibration transmitted from a base of a cosmetic compact to at least one cosmetic pan supported within the cosmetic compact. The at least one cosmetic pan is adapted to contain solid or semi-solid cosmetic, e.g., a pressed powder, which is susceptible to damage in the form of cracking or crumbling, or in the worst case, release from the pan. The shock absorbing means minimizes or eliminates damage to the cosmetic product caused by external shock, impact or vibration.

According to an embodiment of the present disclosure, there is provided a cosmetic compact comprising a lid and a base assembly comprising a base, a frame, a shock absorbing member, and at least one cosmetic pan.

According to an aspect of the present disclosure, the lid can be coupled to the base and configured to operate between a closed position and an open position. The lid covers the base to avoid exposing the cosmetic in the at least one cosmetic pan to accidental contact and preventing use. In the open position, the lid can be configured to expose the at least one cosmetic pan in the base for use.

According to yet another aspect of the present disclosure, the lid overlies base to define an interior compartment and is pivotally mounted on the base. Together the base and the lid define a compact casing. The lid has opposed lateral side walls and a front wall which extend generally perpendicularly from a top wall of the lid. The front wall of the lid has an extended portion which fits in a recessed portion of the base when the lid is pivoted downward towards the base to close the cosmetic compact.

According to another aspect of the present disclosure, the base has opposed lateral side walls, a front wall and a rear wall. The front wall of the base has a recessed portion.

The top wall of the lid has an interior surface which may comprise a mirror (not shown), such as a mirror that is laminated to the interior surface or the interior surface may itself be a mirror.

According to another aspect of the present disclosure, a recess and a tab are provided, respectively, on the extended portion of the base and in the recessed portion of the lid, and cooperate to releasably maintain the cosmetic compact in the closed position when the lid is pivoted to close the cosmetic compact with the extended portion engaging the recessed portion of the base. Any suitable closure system known in the art, however, may be used.

According to another aspect of the present disclosure, the frame is coupled to the base and is configured to restrain the at least one cosmetic pan. The frame and the at least one cosmetic pan are disposed inside the base. The base includes a groove that couples to a projection of the frame to help stabilize the frame and prevent movement of the frame within the base. In alternate embodiments of the present disclosure, the frame may be coupled to the base by any other coupling means known in the art.

According to another aspect of the present disclosure, the shock absorbing member is disposed within the base. The shock absorbing member is coupled to the base and is coupled to the at least one cosmetic pan such that some mechanical shock imparted on the cosmetic compact is isolated from the at least one cosmetic pan. Hence, the content of the at least one cosmetic pan, such as, for example, makeup, is isolated from shock or vibration acting upon the cosmetic compact. The shock absorbing member fills in a substantially complete space between the frame and the bottom wall of the base to prevent transverse or axial movements of the at least one cosmetic pan relative to the frame and the base and dampens effect of impact on the at least one cosmetic pan during a fall or vibrations.

According to another aspect of the present disclosure, the shock absorbing member is shaped and sized corresponding to a cavity of the base. Particularly, outer surfaces of lateral sidewalls, front wall and rear wall of the shock absorbing member corresponds to inner surfaces of the lateral sidewalls, front wall and rear wall of the base respectively.

According to another aspect of the present disclosure, the shock absorbing member is substantially thick such that a maximum thickness of the shock absorbing member is at least 50 percent of a depth of the cavity of the base. In an embodiment, the shock absorbing member is substantially thick such that a thickness of at least one of the lateral sidewalls, front wall and rear wall is at least 50 percent of a depth of the cavity of the base.

Further, the shock absorbing member comprises at least a sheet of material having a honey comb structure i.e. the shock absorbing member comprises at least one sheet of material having a plurality of honeycomb shaped hexagonal voids. The hexagonal voids having open top and bottom ends. The honey comb structure improves impact resistance of the material of the shock absorbing member and is light in weight because many cells separated by partition walls are arranged vertically and laterally. The honeycomb shaped structure provides a material with minimal density and relative high out-of-plane compression properties and out-of-plane shear properties. Further, the shock absorbing member is preferably made of a flexible material.

The shock absorbing member further includes at least one well formed on a top side thereof adapted to receive the at least one cosmetic pan. The at least one well has a depth smaller than the maximum thickness of the shock absorbing member. The at least one well has a depth smaller than the thickness of at least one of the lateral sidewalls, front wall and rear wall of the shock absorbing member. The at least one cosmetic pan seats conformingly in the at least one well of the shock absorbing member. The at least one cosmetic pan may be attached to the at least one well by a glue, a tight fitment or any other attaching means known in the art.

Furthermore, the frame includes an opening that provides access to the contents of the at least one cosmetic pan. The frame locks the at least one cosmetic pan with the shock absorbing member within the base. Particularly, a lower projection extending from an lower surface of a top wall of the frame abuts an outer flange extending laterally from an outer surface near a top end of a side wall of the at least one cosmetic pan for securing the at least one cosmetic pan with the shock absorbing member within the base. More particularly, an inner side outer surface and a lower side outer surface of the lower projection abut a corresponding outer surface of the side wall of the cosmetic pan and a top surface of the outer flange respectively.

Further, remaining outer surfaces of the cosmetic pan namely a side outer surface of the outer flange, a lower outer surface of the outer flange, an outer surface near a bottom end of the sidewall of the cosmetic pan and an outer surface of the lower wall of the cosmetic pan abuts corresponding inner surfaces of the shock absorbing member.

According to yet another embodiment, assembling of the base assembly of the cosmetic compact comprises following steps:

1. The shock absorbing member is first securely received in the cavity of the base.

2. Subsequently, the at least one cosmetic pan is secured to the at least one well of the shock absorbing member.

3. Thereafter, the frame is mounted over the base to retain the at least one cosmetic pan within the base.

According to an aspect of the present disclosure, the shock absorbing member may be made from any suitable material including plastic or elastomer material, such as, for example, rubber, styrene, acetal, polyethylene, polypropylene. The shock absorbing member may be made by any suitable method, such as, for example, injection molding, die-cutting, etc.

According to an aspect of the present disclosure, the at least one cosmetic pan may be made from a metal material such as aluminium or plastic or any other material known in art.

According to an aspect of the present disclosure, at least one of said lid and said base is made of a material selected from the group consisting of transparent plastic, opaque plastic, metal, wood, composite, polymer, and ceramic.

According to an aspect of the present disclosure, the lid and/or the base, may take any shape desired, such as, but not limited to, circular, square, rectangular, polygonal, etc. The lid generally has the same or a similar geometric shape as the base. Also, both the interior surface and the exterior surface of the lid may have one or more decorative features attached to the interior surface and/or exterior surface of the lid or decorative features may be a part of the interior surface and/or exterior surface of the lid or printed or painted onto such surfaces.

In an embodiment of the disclosure, the lid, particularly the interior surface and/or exterior surface of the lid may be clear or opaque to allow for viewing of the contents of the compact case when the lid is in a closed position.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
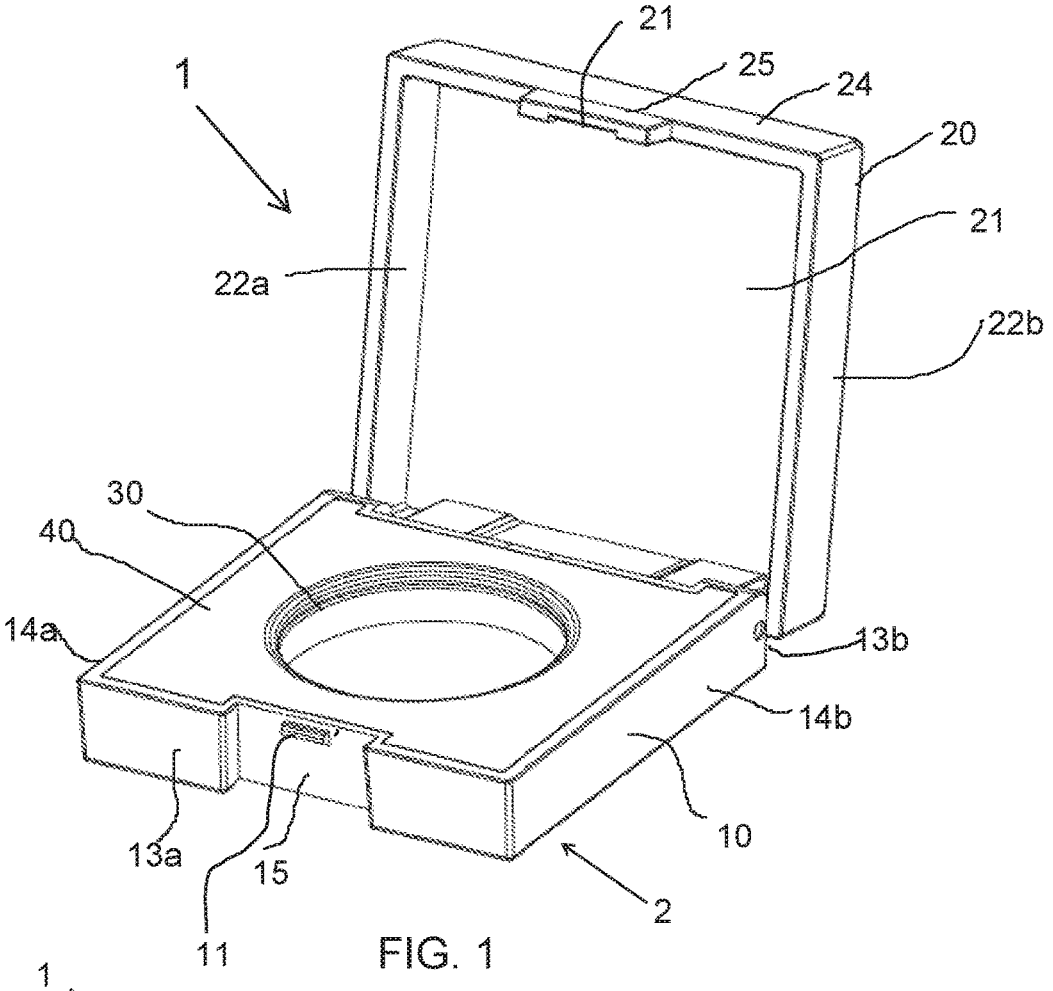
FIG. 1 illustrates a perspective view of a cosmetic compact in an open configuration according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

FIG. 1 illustrates an exemplary embodiment of a cosmetic compact 1 in an open configuration. The cosmetic compact 1 comprising a lid 20 and a base assembly 2 comprising a base 10, a frame 40, a shock absorbing member 50 (see FIG. 2), and at least one cosmetic pan 30.

Figure 2:
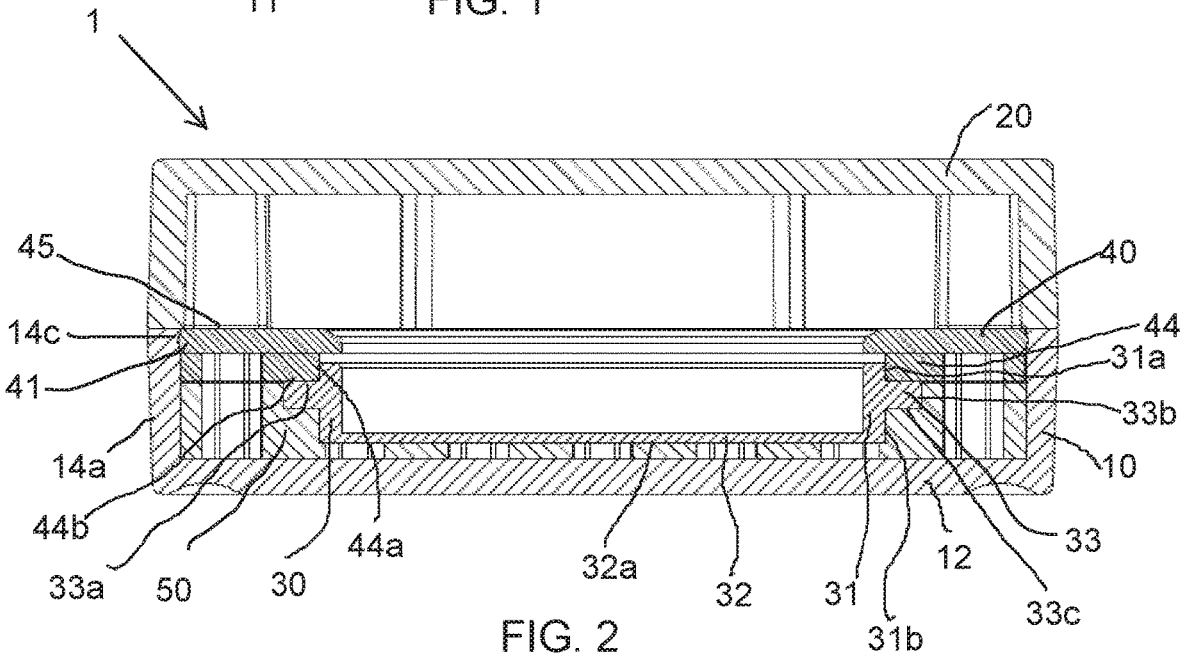
FIG. 2 illustrates a cross sectional view of the cosmetic compact of FIG. 1 in a closed position.

The cosmetic compact 1 has a base 10 having a bottom wall 12 (as shown in FIG. 2). The base 10 can be configured to house at least one cosmetic pan 30. A lid 20 can be coupled to the base 10 and configured to operate between a closed position and an open position. The lid 20 covers the base 10 to avoid exposing the cosmetic in the at least one cosmetic pan 30 to accidental contact and preventing use. In the open position, the lid 20 can be configured to expose the at least one cosmetic pan 30 in the base for use.

As shown in the drawings, particularly FIGS. 1-2, the base 10 has opposed lateral side walls 14*a*, 14*b*, a front wall 13*a* and a rear wall 13*b*. The front wall 13*a* has a recessed portion 15.

More particularly, the lid 20 overlies the base 10 to define an interior compartment and is pivotally mounted on the base 10. Together the base 10 and the lid 20 define a compact casing. The lid 20 has opposed lateral side walls, 22*a*, 22*b*, and a front wall 24, which extend generally perpendicularly from a top wall 21. The front wall 24 of the lid 20 has an extended portion 25 which fits in the recessed portion 15 when the lid 20 is pivoted downward towards the base 10 to close the cosmetic compact 1.

The top wall 21 of the lid has an interior surface which may comprise a mirror (not shown), such as a mirror that is laminated to the interior surface or the interior surface may itself be a mirror.

A recess 21 and a tab 11 are provided, respectively, on the extended portion 25 and in the recessed portion 15, and cooperate to releasably maintain the cosmetic compact 1 in the closed position when the lid 20 is pivoted to close the cosmetic compact 1 with the extended portion 25 engaging the recessed portion 15. Any suitable closure system known in the art, however, may be used.

The lid 20 generally has the same or a similar geometric shape as the base 10. Also, both the interior surface and the exterior surface of the lid may have one or more decorative features attached to the interior surface and/or exterior surface of the lid or decorative features may be a part of the interior surface and/or exterior surface of the lid or printed or painted onto such surfaces.

In an embodiment of the disclosure, the lid, particularly the interior surface and/or exterior surface of the lid may be clear or opaque to allow for viewing of the contents of the compact case when the lid is in a closed position.

The cosmetic compact 1 also includes a frame 40 coupled to the base 10 and configured to restrain the at least one cosmetic pan 30.

As shown in FIG. 2, the frame 40 and the at least one cosmetic pan 30 are disposed inside the base 10. The base 10 includes a groove 14*c* that couples to a projection 41 of the frame 40 to help stabilize the frame 40 and prevent movement of the frame 40 within the base 10.

Figure 3:
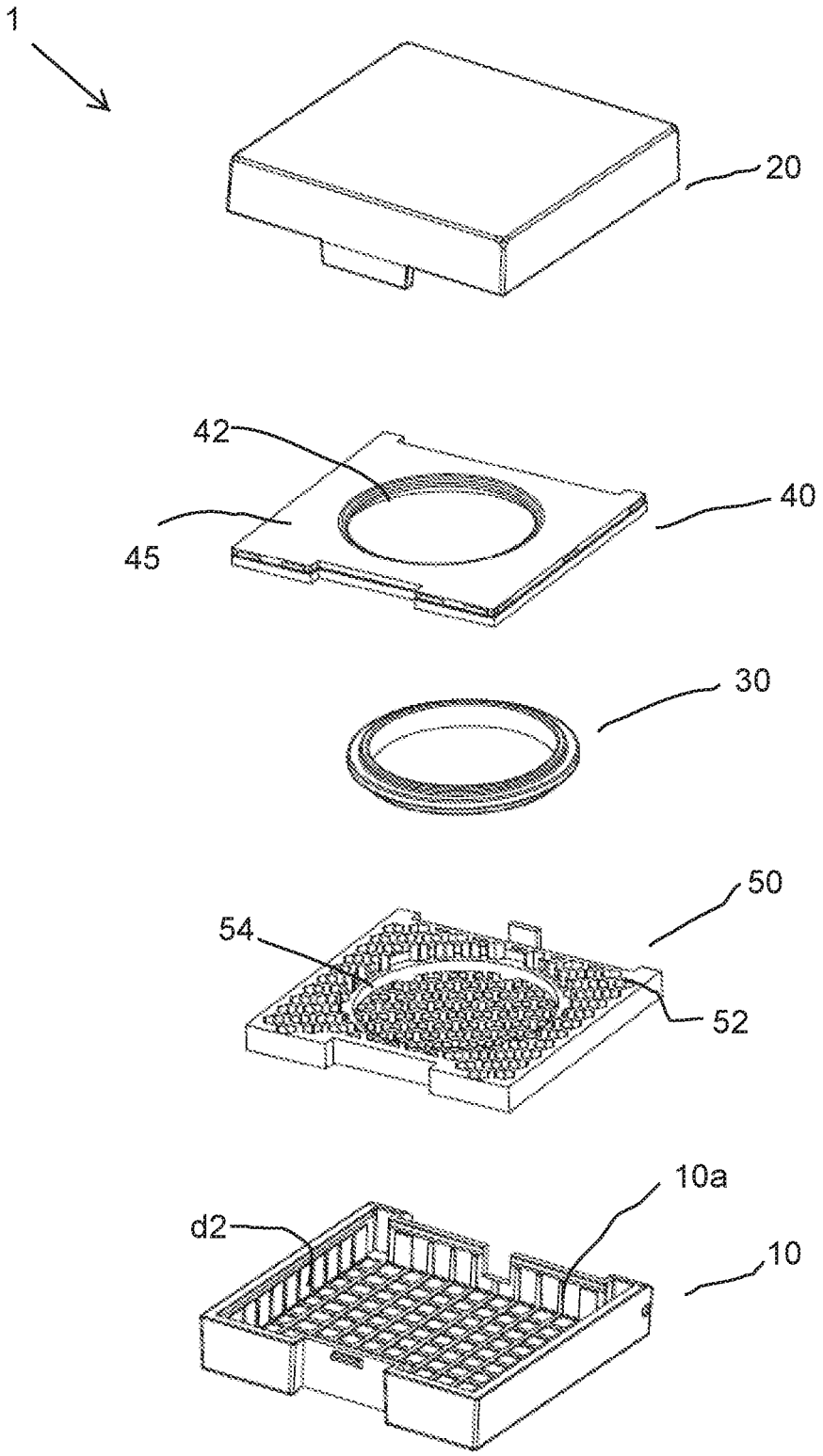
FIG. 3 illustrates an exploded view of the cosmetic compact of FIG. 1.
Figure 4:
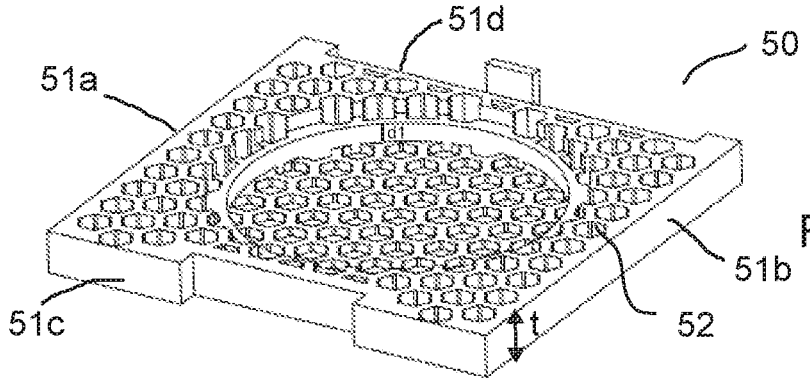
FIG. 4 illustrates a perspective view of a shock absorbing member of FIG. 3.

As shown in FIGS. 2-4, the cosmetic compact 1 includes a shock absorbing member 50 disposed within the base 10. The shock absorbing member 50 is coupled to the base 10 and is coupled to the at least one cosmetic pan 30 such that some mechanical shock imparted on the cosmetic compact 1 is isolated from the at least one cosmetic pan 30. Hence, the content of the at least one cosmetic pan 30, such as, for example, makeup, is isolated from shocks or vibrations acting upon the cosmetic compact 1. The shock absorbing member 50 fills in a substantially complete space between the frame 40 and the bottom wall of the base 20 to prevent transverse or axial movements of the at least one cosmetic pan 30 relative to the frame 40 and the base 10 and dampens effect of impact on the at least one cosmetic pan 30 during a fall or vibration.

The shock absorbing member 50 is shaped and sized corresponding to a cavity 10*a* of the base 10. Particularly, outer surfaces of lateral sidewalls 51*a*, 51*b*, front wall 51*c* and rear wall 51*d* of the shock absorbing member 50 corresponds to inner surfaces of the lateral sidewalls 14*a*, 14*b*, front wall 13*a* and rear wall 13*b* of the base 10 respectively.

The shock absorbing member 50 is substantially thick such that a maximum thickness t (see FIG. 4) of the shock absorbing member is at least 50 percent of a depth d2 (see FIG. 3) of the cavity 10*a* of the base 10. Particularly, the shock absorbing member 50 is substantially thick such that a thickness t of at least one of the lateral sidewalls 51*a*, 51*b*, front wall 51*c* and rear wall 51*d* is at least 50 percent of a depth d2 of the cavity 10*a* of the base 10.

The shock absorbing member 50 comprises at least a sheet of material having a honey comb structure i.e. the shock absorbing member 50 comprises at least one sheet of material having a plurality of honeycomb shaped hexagonal voids 52. The hexagonal voids 52 having open top and bottom ends. The honey comb structure improves impact resistance of the material of the shock absorbing member 50 and is light in weight because many cells separated by partition walls are arranged vertically and laterally. The honeycomb shaped structure provides a material with minimal density and relative high out-of-plane compression properties and out-of-plane shear properties. Further, the shock absorbing member 50 is preferably made of a flexible material.

The shock absorbing member 50 further includes at least one well 54 formed on a top side thereof and adapted to receive the at least one cosmetic pan 30. The at least one well 54 has a depth d1 (see FIG. 4) smaller than the maximum thickness t of the shock absorbing member 50. The at least one well 54 has a depth smaller than the thickness t of at least one of the lateral sidewalls 51*a*, 51*b*, front wall 51*c* and rear wall 51*d* of the shock absorbing member 50. The at least one cosmetic pan 30 seats conformingly in the at least one well 54 of the shock absorbing member 50. The at least one cosmetic pan 30 may be attached to the at least one well 54 by a glue, a friction tight fitment or any other attaching means known in the art.

Further, the frame 40 includes an opening 42 (see FIG. 3) that provides access to the contents of the at least one cosmetic pan 30. The frame 40 locks the at least one cosmetic pan 30 with the shock absorbing member 50 within the base 10. Particularly, a lower projection 44 extending from a lower surface of a top wall 45 of the frame 40 abuts an outer flange 33 extending laterally from an outer surface near a top end of a side wall 31 of the at least one cosmetic pan 30 for securing the at least one cosmetic pan 30 with the shock absorbing member 50 within the base 10, as shown in FIG. 2. More particularly, an inner side outer surface 44*a* and lower side outer surface 44*b* of the lower projection 44 abut a corresponding outer surface 31*a* of the side wall 31 of the cosmetic pan 30 and a top surface 33*a* of the outer flange 33 respectively.

Further, remaining outer surfaces of the cosmetic pan 30 namely a side outer surface 33*b* of the outer flange 33, a lower outer surface 33*c* of the outer flange 33, an outer surface 31*b* near a bottom end of the sidewall 31 of the cosmetic pan 30 and an outer surface 32*a* of the lower wall 32 of the cosmetic pan 30 abut corresponding inner surfaces of the shock absorbing member 50.

Figure 5:
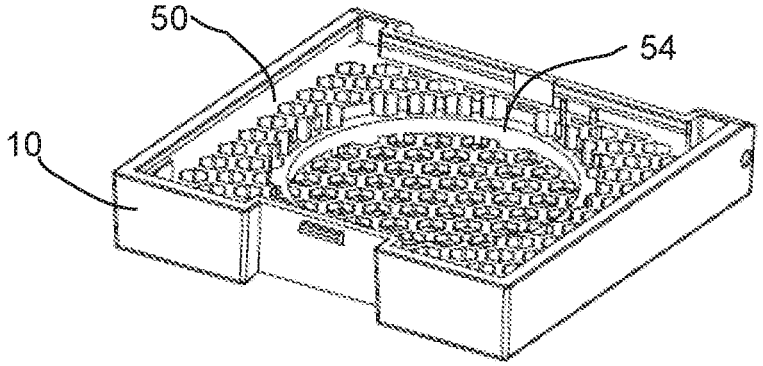
FIG. 5-7 illustrates steps of assembling a base assembly of the cosmetic compact of FIG. 1.
Figure 6:
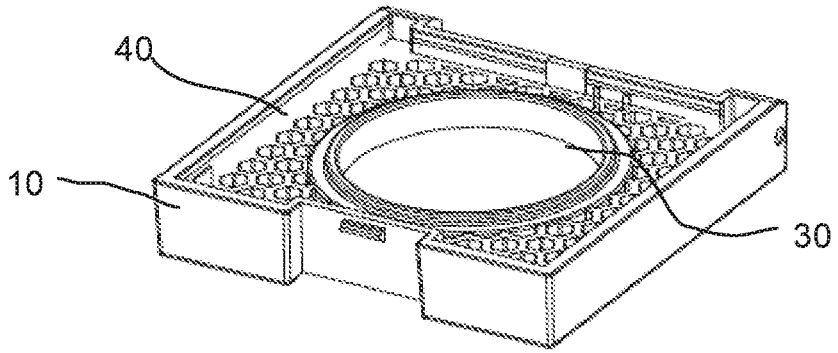
Figure 7:
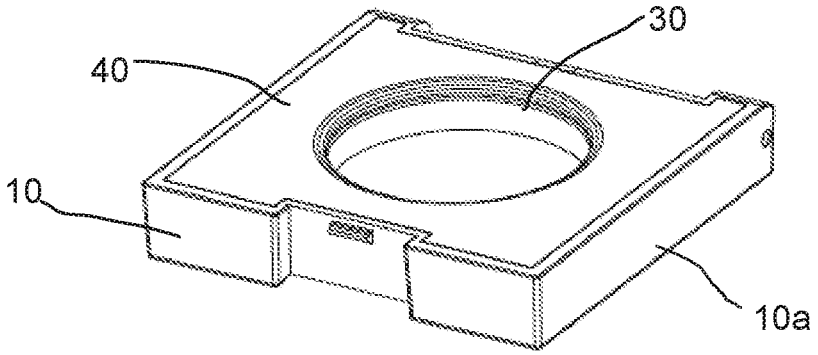

Furthermore, FIGS. 5-7 show steps of assembling a base assembly 2 of the cosmetic compact 1. The shock absorbing member 50 is first securely received in the cavity 10*a* of the base 10 as shown in FIG. 5. Subsequently, the at least one cosmetic pan 30 is secured to the at least one well 54 of the shock absorbing member 50 as shown in FIG. 6. Thereafter, the frame 40 is mounted over the base 10 to retain the at least one cosmetic pan 30 within the base 10 as shown in FIG. 7.

According to an aspect of the present disclosure, the shock absorbing member 50 may be made from any suitable plastic or elastomer material, such as, for example, rubber, styrene, acetal, polyethylene, polypropylene. The shock absorbing member may be made by any suitable method, such as, for example, injection molding, die-cutting, etc.

According to an aspect of the present disclosure, the at least one cosmetic pan 30 may be made from a metal material such as aluminium or plastic or any other material known in art.

At least one of said lid 20 and said base 10 is made of a material selected from the group consisting of transparent plastic, opaque plastic, metal, wood, composite, polymer, and ceramic.

The lid 10 and/or the base 20, may take any shape desired, such as, but not limited to, circular, square, rectangular, polygonal, etc.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A cosmetic compact for housing a cosmetic product, the cosmetic compact comprising:

a base assembly, the base assembly having a front surface and a side surface, the front surface having a tab;

a lid configured to cover the base assembly, the lid having a recess configured to receive the tab, wherein the base assembly comprises:

a base configured to be covered by the lid and configured to house a cosmetic pan; and a shock absorbing member disposed within the base; wherein the shock absorbing member comprises at least one well for receiving the cosmetic pan, the shock absorbing member having an inner member sidewall for receiving the cosmetic pan, wherein the well has a depth smaller than a height of the cosmetic pan, and wherein the shock absorbing member comprises at least a sheet of material having a honey comb structure comprising a plurality of hexagonal voids, wherein the shock absorbing member is substantially thick such that a maximum thickness of the shock absorbing member is at least 50 percent of a depth of a cavity of the base.

2. A cosmetic compact according to claim 1, wherein the lid is pivotally mounted on the base.

3. A cosmetic compact according to claim 1, wherein the hexagonal voids have open top and bottom ends.

4. A cosmetic compact according to claim 1, wherein the shock absorbing member is shaped and sized corresponding to a cavity of the base such that the shock absorbing member fills in a substantially complete space of the cavity between the frame and a bottom wall of the base to prevent movement of the at least one cosmetic pan relative to the frame and the base.

5. A cosmetic compact according to claim 1, wherein outer surfaces of lateral sidewalls, front wall and rear wall of the shock absorbing member corresponds to inner surfaces of lateral sidewalls, front wall and rear wall of the base respectively.

6. A cosmetic compact, for housing a cosmetic product, the cosmetic compact comprising a lid and a base assembly wherein the base assembly comprises:

a base configured to be covered by the lid and configured to house at least one cosmetic pan; and a shock absorbing member disposed within the base; wherein the shock absorbing member comprises at least one well for receiving the at least one cosmetic pan, wherein the well has a depth smaller than a height of the cosmetic pan, and wherein the shock absorbing member comprises at least a sheet of material having a honey comb structure comprising a plurality of hexagonal voids, and wherein the shock absorbing member is substantially thick such that a maximum thickness of the shock absorbing member is at least 50 percent of a depth of a cavity of the base.

7. A cosmetic compact according to claim 5, wherein the shock absorbing member is substantially thick such that a maximum thickness of at least one of the lateral sidewalls, front wall and rear wall is at least 50 percent of a depth of the cavity of the base.

8. A cosmetic compact, for housing a cosmetic product, the cosmetic compact comprising:

a lid and a base assembly wherein the base assembly comprises:

a base configured to be covered by the lid and configured to house at least one cosmetic pan; and a shock absorbing member disposed within the base; wherein the shock absorbing member comprises at least one well for receiving the at least one cosmetic pan, wherein the shock absorbing member comprises at least a sheet of material having a honey comb structure comprising a plurality of hexagonal voids, wherein the at least one well has a depth smaller than a height of the cosmetic pan.

9. A cosmetic compact according to claim 5, wherein the at least one well has a depth smaller than a thickness of at least one of the lateral sidewalls, front wall and rear wall of the shock absorbing member.

10. A cosmetic compact for housing a cosmetic product, the cosmetic compact comprising a lid and a base assembly wherein the base assembly comprises:

a base configured to be covered by the lid and configured to house at least one cosmetic pan;

a frame coupled to the base, wherein the frame is configured to restrain the at least one cosmetic pan within the base;

a shock absorbing member disposed within the base;

wherein the shock absorbing member comprises at least one well for receiving the at least one cosmetic pan; and wherein the shock absorbing member comprises at least a sheet of material having a honey comb structure comprising a plurality of hexagonal voids, wherein the frame is configured to restrain the at least one cosmetic pan within the base, wherein the base includes a groove that couples to a projection of the frame to help stabilize the frame and prevent movement of the frame within the base.

11. A cosmetic compact according to claim 10, wherein the frame includes an opening to provide access to contents of the at least one cosmetic pan.

12. A cosmetic compact according to claim 10, wherein the frame locks the at least one cosmetic pan with the shock absorbing member within the base.

13. A cosmetic compact for housing a cosmetic product, the cosmetic compact comprising a lid and a base assembly wherein the base assembly comprises:

a base configured to be covered by the lid and configured to house at least one cosmetic pan;

a frame coupled to the base, wherein the frame is configured to restrain the at least one cosmetic pan within the base;

a shock absorbing member disposed within the base;

wherein the shock absorbing member comprises at least one well for receiving the at least one cosmetic pan; and wherein the shock absorbing member comprises at least a sheet of material having a honey comb structure comprising a plurality of hexagonal voids, wherein the frame is configured to restrain the at least one cosmetic pan within the base, wherein a lower projection extending from a lower surface of a top wall of the frame abuts an outer flange of the at least one cosmetic pan for securing the at least one cosmetic pan with the shock absorbing member within the base.

14. A cosmetic compact according to claim 13, wherein the outer flange extends laterally from an outer surface near a top end of a side wall of the at least one cosmetic pan.

15. A cosmetic compact according to claim 14, wherein an inner side outer surface and lower side outer surface of the lower projection abut a corresponding outer surface of the side wall of the at least one cosmetic pan and a top surface of the outer flange of the at least cosmetic pan respectively.

16. A cosmetic compact according to claim 13, wherein a side outer surface of the outer flange, a lower outer surface of the outer flange, an outer surface near a bottom end of the sidewall of the at least cosmetic pan and an outer surface of the lower wall of the cosmetic pan abut corresponding inner surfaces of the shock absorbing member.

17. A cosmetic compact according to claim 1, wherein the at least one cosmetic pan may be attached to the at least one well by a glue, or a friction tight fitment.

18. A process for assembling the base assembly of the cosmetic compact according to claim 1, the process comprising:

securely receiving the shock absorbing member in a cavity of the base; and securing the at least one cosmetic pan to the at least one well of the shock absorbing member.

* * * * *